United States Patent [19]

Mazzoni et al.

[11] 4,193,236

[45] Mar. 18, 1980

[54] MULTIPLE GLAZED UNIT HAVING AN ADHESIVE CLEAT

[75] Inventors: Renato J. Mazzoni, Tarentum; George R. Mistrick, Leechburg; Barent A. Rosskamp, Tarentum, all of Pa.

[73] Assignee: PPG Industries, Inc., Pittsburgh, Pa.

[21] Appl. No.: 873,326

[22] Filed: Jan. 30, 1978

[51] Int. Cl.[2] ..... E06B 7/12

[52] U.S. Cl. ..... 52/172; 52/398; 428/34

[58] Field of Search ..... 52/171, 172, 398–400; 428/34

[56] References Cited

U.S. PATENT DOCUMENTS

| | | | |
|---|---|---|---|
| 2,684,266 | 7/1954 | Englehart | 52/172 |
| 3,030,673 | 4/1962 | London | 52/172 |
| 3,280,523 | 10/1966 | Stroud et al. | 52/172 |
| 3,473,988 | 10/1969 | Rullier et al. . | |
| 3,553,913 | 1/1971 | Eisenberg | 52/172 |
| 3,771,276 | 11/1973 | Stewart et al. | 52/172 |
| 3,832,254 | 8/1974 | Bowser et al. | 52/172 |
| 3,852,149 | 12/1974 | Sitter et al. | 52/172 X |
| 3,868,805 | 3/1975 | Battersby | 52/402 X |
| 3,935,683 | 2/1976 | Derner et al. | 52/172 |
| 4,057,945 | 11/1977 | Kessler | 52/172 |
| 4,080,482 | 3/1978 | Lacombe | 52/172 |

FOREIGN PATENT DOCUMENTS

| | | | |
|---|---|---|---|
| 1095475 | 12/1960 | Fed. Rep. of Germany | 52/172 |
| 1434283 | 10/1968 | Fed. Rep. of Germany | 52/172 |
| 1117028 | 6/1968 | United Kingdom | 52/172 |

*Primary Examiner*—J. Karl Bell

*Attorney, Agent, or Firm*—Donald Carl Lepiane

[57] ABSTRACT

Adhesive cleats having (1) adhesion in shear and (2) shear resistance of greater than about 40 pounds per square inch (2.80 kilograms per square centimeter) adhere a desiccative spacer to adjacent glass sheets to prevent spacer sag and/or spacer bow. A moisture-impervious sealant seals the airspace between the glass sheets to provide a multiple glazed unit.

22 Claims, 6 Drawing Figures

MULTIPLE GLAZED UNIT HAVING AN ADHESIVE CLEAT

BACKGROUND OF THE INVENTION

1. Field of the Invention:

This invention relates to a multiple glazed unit.

2. Discussion of the Prior Art and Technical Problems:

In general, multiple glazed units of the prior art include a desiccative spacer mounted between glass sheets or panes to provide an airspace therebetween. A moisture-impervious sealant seals the glass sheets and spacer to prevent moisture from moving into the airspace. A metal channel may be mounted on the peripheral and outer marginal edge portions of the glass sheets to protect the edges of the glass sheets and provide additional structural stability. It has been observed that the spacer of the prior art multiple glazed units may sag and/or bow after the units are in service. The term "spacer sag" as used herein is defined as displacement of the spacer toward the airspace. The term "spacer bow" as used herein is defined as displacement of the spacer away from the center of the airspace. The term "displacement of the spacer" and "spacer displacement" as used herein refers to "spacer sag" and/or "spacer bow".

When spacer sag occurs, the spacer moves into the vision area of the unit and detracts from the aesthetic appeal of the unit. In the instance where a metal channel is employed and/or the unit is mounted in a glazing system, spacer bow may cause chipping and flaking of the sharp, raw-cut glass edge as the spacer moves past the glass edge. This is attributed to edge pressure exerted by the channel and/or glazing system. As is well known in the art, glass edge damage weakens the glass sheets causing them to fracture. This is especially true when the glass sheets are heat absorbing and/or have a heat absorbing coating. Repeated spacer displacement, in addition to the above drawbacks, can rupture the moistureimpervious seal allowing moisture to move into the airspace. When this occurs, the desiccative spacer becomes saturated with moisture, and the excess moisture condensing on the inner surfaces of the glass sheets detracts from the aesthetic appeal of the unit; impairs the view of observer and reduces insulating properties of the unit.

Metal washers mounted on the peripheral edge portions of the glass sheets and a metal screw passing through the hole of the washer into engagement with the spacer, i.e., metal clips, have been employed to prevent spacer sag. Although the use of metal clips tend to reduce spacer sag, there are limitations. More particularly, as the spacer sags, the washers are urged against the edges of the glass sheets which can cause chipping and subsequent weakening of the glass edge portions. Another limitation is that the metal clips do not prevent spacer bow because the screw merely passes through the hole in the metal washer when the spacer bows.

Although the mechanism(s) that cause(s) spacer sag and/or spacer bow is(are) not completely understood, many theories are postulated. One of the mechanisms that is believed to cause spacer sag is change in atmospheric pressure. When atmospheric pressure acting on the glass sheets increases, the spacer is urged toward the center of the unit because the air pressure in the airspace is less than the atmospheric pressure acting on the unit. When the atmospheric pressure acting on the glass sheets decreases, the spacer bows because the air pressure in the airspace is greater than the atmospheric pressure acting on the unit.

Using a breather tube of the type taught in U.S. Pat. No. 3,771,276 does not respond fast enough to equalize the air pressure in the airspace to atmospheric air pressure to prevent spacer displacement. Enlarging the hole of the breather tube for faster response to atmospheric pressure changes permits faster ingress of surrounding moisture containing air which would result in premature saturation of the desiccative spacer.

Another mechanism that is believed to cause spacer sag is temperature increases during daylight hours. As the temperature of the air in the airspace increases, e.g., due to solar heat, the air expands exerting an outward pressure on the glass sheets which increases the spaced distance between the glass sheets. The result is less resistance to spacer sag. Further, solar heat and/or radiation softens the adhesive securing the spacer to the glass sheets, and the adhesive has less resistance to spacer movement. It has been found that the adhesive securing the spacer to the glass pane is heated to temperatures of about 130° F. (55° C.) by solar heat and/or radiation. Spacer sag may also be caused by edge pressure of the glazing system on the marginal edge portions of the unit. In general, as the clamping pressure increases, the probability of spacer sag increases.

U.S. Pat. No. 3,868,805 teaches a double glazing unit having a spacer disposed between two panes of glass and spaced inwardly from the peripheral edges thereof to form a peripheral channel. The spacer has a T-shaped cross-sectional configuration to provide spaced recesses between the spacer and inner surface of adjacent panes. A soft and permanently deformable adhesive is applied in the recesses (1) to provide superficial adherence to the panes when the spacer is assembled therewith and (2) to aid in holding the spacer and panes in registry during assembly. Thereafter, the peripheral channel is filled with a hot resinous material to seal the joints between the spacer and panes.

The glazed unit taught in the above-mentioned patent does not eliminate spacer sag and/or spacer bow because the soft and permanently deformable adhesive does not provide sufficient structural stability to prevent spacer displacement.

U.S. Pat. No. 3,473,988 teaches a multiple glazed unit having three coextensive panes spaced apart in parallel relation by strips of polyisobutylene adhered between adjacent glass panes and spaced from the peripheral edges to form peripheral channels which are filled with a silicone elastomer. In accordance with the teachings of the above-identified patent, the polyisobutylene provides a joint that is impermeable to water vapor, and the silicone elastomer provides adhesion to hold the panes in position.

U.S. patent application Ser. No. 758,876 filed on Jan. 12, 1977, now abandoned in the names of G. H. Bowser, R. J. Mazzoni and L. F. Schutrum for "Method of Fabricating A Solar Heat Collector", which is a continuation of abandoned U.S. patent application Ser. No. 550,679, filed Feb. 18, 1975, teaches a method of fabricating a solar collector of the type having cover plates, two spacer frames and a solar radiation absorber. In general, one of the spacer frames is mounted between the cover plates and the other spacer frame is mounted between a cover plate and the absorber. The spacer frames are bonded to their respective cover plates and absorber by a preheated moisture-impervious adhesive.

The above-mentioned patent application on page 8, lines 21–26, teaches that the moisture-impervious adhesive may be a silicone adhesive.

There are no teachings in the above-mentioned patent and patent application that adhesive cleats may be used to prevent spacer sag and/or spacer bow in multiple glazed units.

U.S. patent application Ser. No. 454,337 filed on Mar. 25, 1974, now patent No. 4,109,431 in the names of R. J. Mazzoni and G. H. Bowser for a "Sealing And Spacing Unit For Multiple Glazed Windows" and assigned to PPG Industries, Inc. teaches a spacing and sealing strip. The strip has a flexible dehydrator strip adhered to a flexible metal base by a layer of adhesive. Disposed on the base in a lengthwise manner are two strips of cold flowable, moisture-resistant sealant. The sealant mounts the spacing and sealing strip on the peripheral and outer marginal edge portions of glass sheets, and the dehydrator strip maintains the glass sheets in spaced relation.

Although the spacing and sealing strip of the above-identified patent application is suitable for its intended purpose, there are limitations. One of these limitations is that the dehydrator strip is secured to a flexible metal base and not adjacent glass sheets. Therefore, if the adhesive does not provide a strong enough bond between the metal base and dehydrator strip and/or if the sealant does not provide a strong enough bond between the glass sheets and metal base, spacer displacement may occur.

As can be appreciated, it would be advantageous to provide a multiple glazed unit that does not have the limitations of the prior art, e.g., spacer displacement.

SUMMARY OF THE INVENTION

This invention relates to an improved method of fabricating a multiple glazed unit to eliminate spacer displacement. The method, which is improved, includes the steps of mounting a spacer between a pair of glass sheets or panes to provide an airspace therebetween. Thereafter, the airspace is sealed with a moisture-impervious sealant. The improvement includes the step of securing the panes and spacer together with an adhesive cleat having a shear property of greater than about 40 pounds per square inch (2.80 kilograms per square centimeter) to prevent spacer displacement.

This invention also relates to an improved multiple glazed unit of the type having a pair of panes mounted about a spacer to provide an airspace therebetween. A moisture-resistant sealant seals the airspace to prevent moisture from moving therein. The improvement includes an adhesive cleat having a shear property of greater than about 40 pounds per square inch (2.80 kilograms per square centimeter) mounting the panes and the spacer to prevent spacer displacement.

The term "shear property" as used herein is defined as the adhesive strength of the cleat under shear forces and the shear force required to rupture the adhesive cleat.

BRIEF DESCRIPTION OF THE INVENTION

This invention relates to the use of an adhesive cleat to minimize or eliminate spacer sag and/or spacer bow in multiple glazed units. In the following discussion, like numerals refer to like elements.

Figure 1:
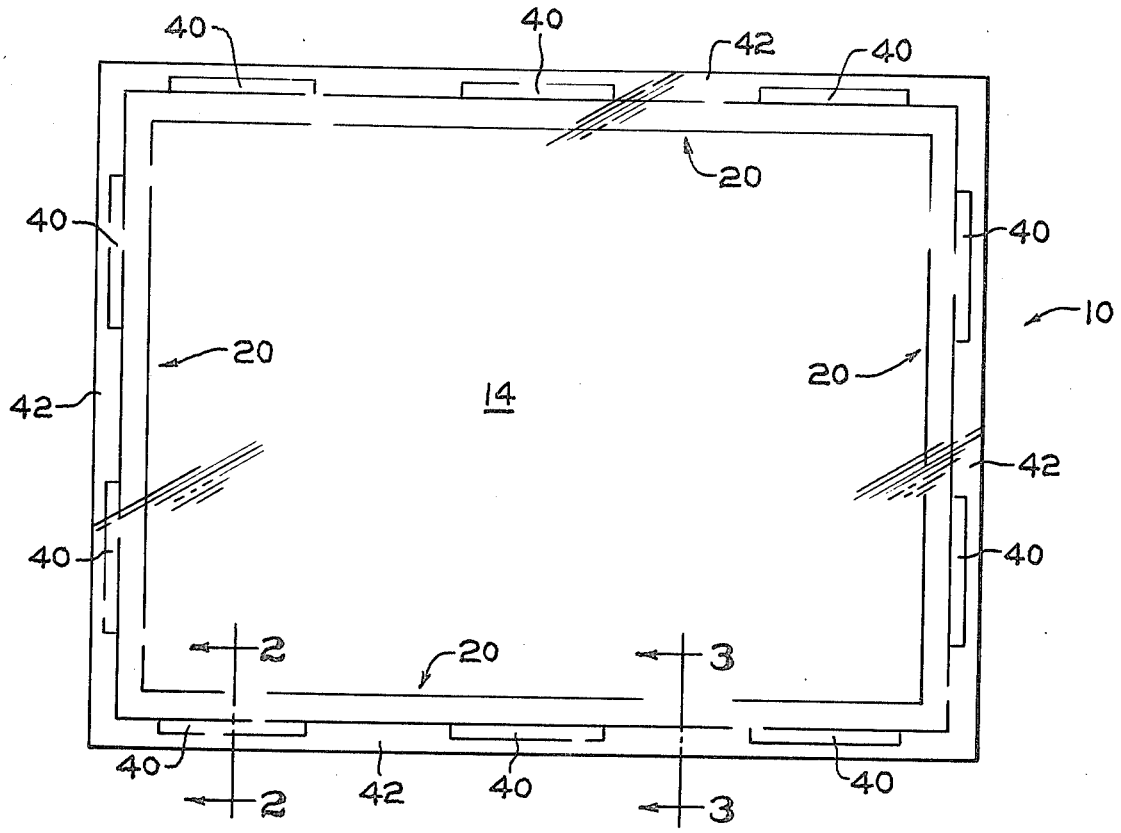
FIG. 1 is a frontal view of a multiple glazed unit constructed in accordance to the teachings of the invention to prevent spacer displacement.
Figure 2:
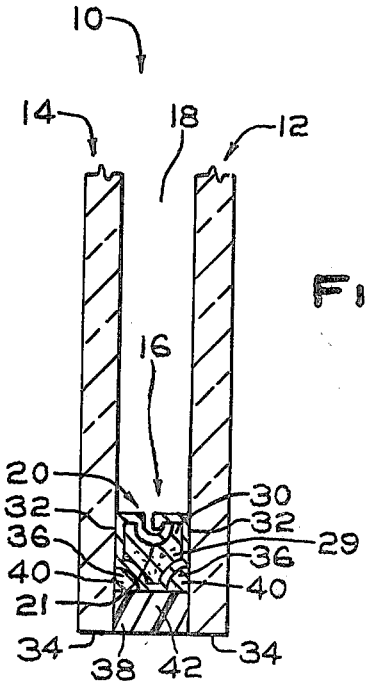
FIG. 2 is a view taken along lines 2—2 of FIG. 1.
Figure 3:
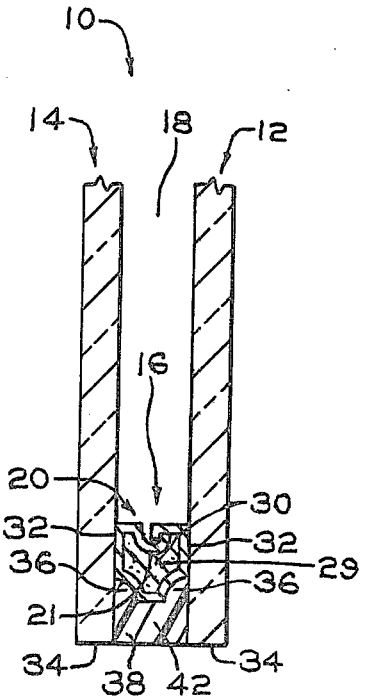
FIG. 3 is a view taken along lines 3—3 of FIG. 1.

With reference to FIGS. 1–3, and more particularly to FIGS. 2 and 3, multiple glazed unit 10 includes a pair of glass sheets or panes 12 and 14 separated by a spacer 16 to provide an airspace 18 therebetween. The spacer 16 may be any of the types used in the multiple glazing art and generally includes rolled aluminum or galvanized steel sections 20 abuted or joined at their ends in any conventional manner, e.g. by corner keys or welding (not shown). The sections 20 of the spacer 16 may have a T-shaped cross-sectional configuration having an internal lock seam 21 as shown for the spacer 16 of unit 10 (FIGS. 2 and 3) and unit 22 (FIG. 5) or may have a rectangular cross-sectional configuration having an external lockseam 23 as shown for section 24 of spacer 26 of multiple glazed unit 28 shown in FIG. 4.

With reference to FIGS. 2–5, the sections 20 and 24 of the spacers 16 and 26, respectively, each have a cavity 29 for containing a desiccant 30 of the type used in the multiple glazing art. The desiccant 30 communicates with the airspace 18 in any conventional manner, e.g., through the lockseam 21 or 23 to absorb moisture therein.

With specific reference to FIGS. 2 and 3, the glass sheets 12 and 14 engage adjacent marginal edge portions 32 of the spacer section 20 with the spacer section 20 spaced inwardly from peripheral edge portion 34 of the glass sheets 12 and 14 to form a pair of spaced peripheral recesses 36 and a peripheral channel 38. The recesses 36 are selectively filled with adhesive cleats or strips 40 as shown in FIGS. 1 and 2 having a shear property of greater than about 40 pounds per square inch (2.80 kilograms per square centimeter) and preferably greater than about 60 pounds per square inch (4.20 kilograms per square centimeter) to structurally secure the spacer 16 to the glass sheets 12 and 14 to eliminate or minimize spacer sag and/or spacer bow. Stated another way, the adhesive cleat at the interface of the spacer and adjacent glass pane and the adhesive itself will not shear or rupture at shear forces of less than 40 pounds per square inch (2.80 kilograms per square centimeter) and preferably at shear forces of less than 60 pounds per square inch (4.20 kilograms per square centimeter).

In accordance to the teachings of the invention, the shear property of the adhesive may be determined in the following manner which is a modification of test procedure ASTM D-1002. Two plates each having a thickness of about ¼ inch (0.64 centimeter); a width of about 1 inch (2.45 centimeters); and a length of about 3 inches (7.59 centimeters) are cleaned in any conventional manner to remove grease and dirt. A layer of the adhesive to be tested for use as a cleat having a thickness of about ⅛ inch (0.32 centimeter) and each side having a length of about 1 inch (2.54 centimeters) is applied at one end of a plate. Masking tape may be used to confine the adhesive to the proper area. An end of the other plate overlays the adhesive, and the adhesive is allowed to cure for 14 days at 73±3° F. (23° C. ±2° C.) and 50 ±5% R.H.

After curing, excess adhesive is trimmed from the edges of the plates and thereafter the plates are pulled apart in an Instron Testing Apparatus at a jaw separation rate of 0.2 inches per minute (0.05 centimeters per minute) at room temperature. The breaking strength or shear of each specimen, whether it is an adhesive separation or an adhesive break, is recorded in pounds per square inch (kilograms per square centimeter). The medium value of three specimens is considered the shear property of the adhesive. The shear property may be tested at elevated temperatures by pulling the plates in a heated environment as is known in the art.

Preferably the plates are made of material to be joined by the adhesive cleat when assembled in the glazed unit, e.g., a glass sheet joined to a galvanized steel plate or a glass sheet joined to an aluminum plate. It is recommended that the edges of the glass plate be polished to remove edge damage which may cause the glass plate to fracture during testing.

Other parameters which should be considered in the practice of the invention are the flexibility of the spacer, the volume of the adhesive cleat, the surface area of the glass contacted by the adhesive cleat, the surface area of the spacer contacted by the adhesive cleat, and the length of the spacer.

The above parameters are believed to interact in the following manner. Increasing the shear property of the adhesive cleat while maintaining the remaining parameters constant decreases spacer displacement and vice versa. Decreasing the flexibility of the spacer while maintaining the remaining parameters constant decreases spacer displacement and vice versa because decreasing the flexibility of the spacer reduces its bending moments. The effect of the volume of the adhesive cleat is better understood by considering the length and cross-sectional area of the adhesive cleat. Increasing the length of the cleat while maintaining the cross-sectional area of the cleat and remaining parameters constant decreases spacer displacement and vice versa because increased length of the spacer is adhered to the glass by the cleat. Increasing the cross-sectional area of the cleat while maintaining the length of the cleat and remaining parameters constant may cause spacer displacement because increasing the cross-sectional of the cleat increases its flexibility. Increasing the length of the spacer while maintaining the remaining parameters constant increases spacer displacement because it increases the bending moment of the spacer.

Although not limiting to the invention, it is recommended that the adhesive used for cleats have an oscillating shear fatigue of 40 or more cycles tested in accordance to the test method under "5.2 Oscillting Shear Fatigue" page 25 and 26 of "Guide Specifications for Silicone Construction Sealant" CDS 602 dated May, 1965, and published by General Electric Corporation. As was discussed above, the spacer has a tendency to oscillate between spacer sag and spacer bow. By providing an adhesive that can pass 40 or more cycles, the probability that the adhesive will shear due to oscillating fatigue is minimized. Further, although not limiting to the invention, it is recommended that the displacement of the plates relative to one another during the test for shear property be less than about ¼ inch (0.66 centimeter) at a shear force of greater than about 40 pounds per square inch (2.80 kilograms per square centimeter). In this manner, the deflection of the spacer during spacer bow is maintained and will not move into the vision area of the unit or rupture the seal.

Types of adhesives that have the recommended shear property, but not limiting thereto, are silicone elastomers, polysulfide adhesives, hot melt adhesives and polybutadiene adhesives to name a few.

Referring back to FIGS. 1–3, the peripheral channel 38 as well as the recesses 36 not filled with the adhesive cleats 40 are filled with a moisture-impervious sealant 42 of the type used in the multiple glazing art.

The expressions "moisture-impervious", "moisture-resistant", "barrier against moisture penetration" and "heremetically sealed" as used herein refer to an ability to prevent passage of water vapor to such an extent that the subject material or structure is capable of being utilized in a multiple glazed architectural installation.

To qualify for such architectural use, the material or structure should present enough of an obstacle to water vapor transmission to preclude condensation of water vapor in the interior of a multiple glazed unit at temperatures down to about 0° F. (i.e., about $1.77\times10^{-5}$ grams of water per cubic inch of air [$1.08\times10^{-6}$ grams of water per mm. of air]) in the unit and preferably lower over a period of several years. The time period required is at least about 3 to 5 years but preferably is at least about 10 years and in optimum cases is at least about 20 years.

The amount of water vapor penetration depends not only on the inherent moisture vapor transmission of the material employed as the obstacle but also on the dimensions (e.g., thickness) of the obstacle in the path of water vapor penetration. Because visual aesthetics must be considered in regard to architectural glazing, it is desirable to minimize the dimensions of the water vapor barriers. Thus, materials having a relatively low moisture vapor transmission are preferred. For this reason, it is generally preferred that the materials used for the moisture barriers in multiple glazing have a moisture vapor transmission of less than about 15 grams (preferably less than about 6 grams) for twenty-four hours per square meters per mil thickness at 100° F. and 90% relative humidity as determined by A.S.T.M. E-96-66. Desiccants are often included in multiple glazed units to absorb moisture vapor in the airspace; and when a desiccant is employed, the requirements for moisture barriers may be relaxed by an amount corresponding to the water absorbing capacity of the desiccant.

Moisture-resistant sealants that may be used in the practice of the invention but not limiting thereto are of the type taught in U.S. Pat. Nos. 3,781,910 and 3,971,178 as well as hot melt sealants sold by H. B. Fuller Company of Minneapolis, Minnesota, and Norton Company of Trenton, New Jersey.

Figure 4:
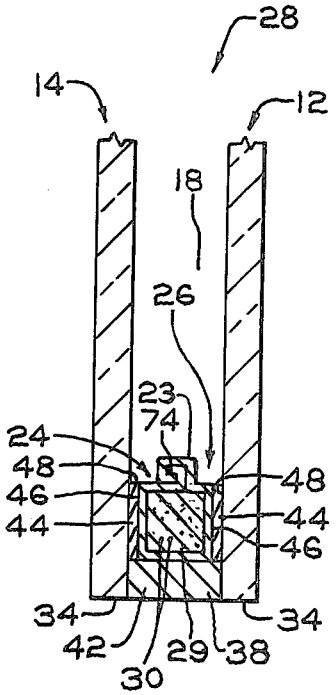
FIG. 4 is a view similar to the view of FIG. 2 showing the use of the adhesive cleat of the invention between glass sheets and a spacer to prevent spacer displacement.

The multiple glazed unit 28 shown in FIG. 4 includes the glass sheets 12 and 14 joined to the spacer 26 by adhesive cleats 44 between marginal edge portions 46 of the spacer 26 and adjacent inner surface portions 48 of the glass sheets 12 and 14. The adhesive cleats 44 may be either discrete strips as shown in FIG. 1 or a continuous strip. The spacer 24 is spaced inwardly from the peripheral edge portions 34 of the glass sheets 12 and 14 to form the peripheral channel 38 which is filled with the moisture-resistant sealant 42.

Figure 5:
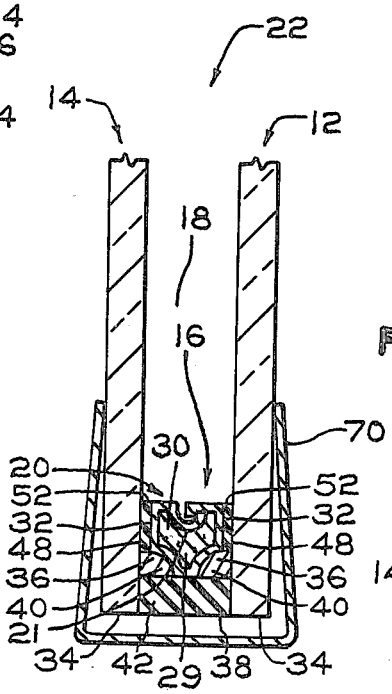
FIG. 5 is a view similar to the view of FIG. 2 showing the use of the adhesive cleat of the invention between moisture-impervious seals of a multiple glazed unit to prevent spacer displacement.

Referring to FIG. 5, the multiple glazed unit 22 has marginal edge portions 32 of the spacer 16 joined to adjacent inner surface portions 48 of the panes 12 and 14 by a layer 52 of the moisture-resistant sealant. The adhesive cleats 40 fill portions of the peripheral recesses 36 while the moisture-resistant sealant 42 fills the peripheral channel 38 and unfilled portions of the peripheral recesses 36 as was discussed for unit 10 shown in FIGS. 1–3.

The adhesive cleats 40 of unit 22 shown in FIG. 5 are not exposed to air because they are between layers 52 and 42 of the moisture-resistant sealant. Therefore, the adhesive selected for the cleats should be capable of curing in the absence of air. Adhesives recommended for cleats in the multiple glazed units of the type shown in FIG. 5 are two component silicone elastomer adhesives such as the type sold by General Electric Corporation identified as GE-3204 or polysulfide adhesives of the type sold by Products Research Company of Glouchester, New Jersey, identified as 428.

Figure 6:
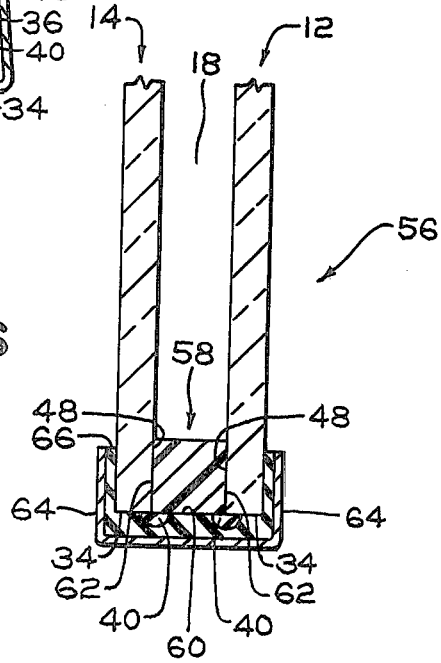
FIG. 6 is a view similar to the view of FIG. 2 showing the use of the adhesive cleat of the invention on peripheral edge portions of a spacer and adjacent glass sheets to prevent spacer displacement.

With reference to FIG. 6, multiple glazed unit 56 has the glass panes 12 and 14 separated by a spacer-dehydrator 58 of the type taught in U.S. Pat. No. 3,758,996, which teachings are hereby incorporated by reference. In general, the spacer-dehydrator 58 may be described as a moisture, vapor-transmittable matrix of a black copolymer of styrene and butadiene having a desiccating material interspersed therein. Peripheral edge portions 60 of the spacer 58 are generally flush with the peripheral edge portions 34 of the panes 12 and 14. Marginal edge portions 62 of the spacer 58 contact the inner marginal edge portions 48 of the panes 12 and 14. The adhesive cleats 40 join adjacent corners of the spacer 58 and the peripheral edges 34 of the glass panes 12 and 14 as shown in FIG. 6. A continuous, flexible ribbon 64 of moisture-resistant material having a layer 66 of the moisture-resistant sealant thereon is applied to peripheral edge portions 34 and 60 of the glass panes and spacer, respectively, and may extend over the outer marginal panes 12 and 14 as shown in FIG. 6. The ribbon 64 having the sealant layer 66 may be of the type taught in U.S. Pat. No. 3,758,996, which teachings are hereby incorporated by reference.

Although not limiting to the invention, edge protection for the units may be provided in the form of a C-shaped channel 70 as shown in FIG. 5 of the type taught in U.S. Pat. No. 3,609,293 which teachings are hereby incorporated by reference.

Although the invention was discussed using two glass sheets separated by a spacer, it can now be appreciated that the invention is not limited thereto. For example, three or more glass sheets may be used; the glass sheets may be coated and/or tempered; the sheets may be made of metal, wood or plastic; and the edge packing, e.g., channel 70 and tape 64 may be used together.

Multiple glazed units (1) without metal clips or adhesive cleats; (2) with metal clips and (3) with adhesive cleats of the invention were tested by simulated expected mounting and environmental conditions to evaluate the effect of the adhesive cleats on spacer displacement and to determine adhesive cleat frequency to minimize or eliminate spacer displacement.

The apparatus for testing the larger units included a $\frac{5}{8}$ inch (1.59 centimeters) thick plywood base having a width about $53\frac{5}{8}$ inches (1.34 meters) and a length of about 110 inches (2.78 meters) and the apparatus for testing smaller units included a $\frac{3}{4}$ inch (1.9 centimeters) thick plywood base having a width of about 38 inches (0.95 meters) and a length of about 80 inches (2 meters). One inch (2.54 centimeters) PITTCO® glazing wall members were mounted on the marginal edges of the base to form a cavity. The screw holes of the members were taped to receive a 5/16–18 NC machine screw. A copper heat exchanger plate of the type taught in U.S. Pat. No. 3,995,613 having a width of about 48 inches (1.2 meters) and a length of about 104 inches (2.55 meters) for the large testing apparatus and a width of about $32\frac{5}{8}$ inches (0.82 meters) and a length of about $74\frac{3}{4}$ inches (1.87 meters) for the smaller testing apparatus is mounted on wooden shims in the cavity and spaced about $\frac{3}{8}$ inch (0.20 centimeter) from adjacent glass sheet of the unit under test. The teachings of the above-identified patent are hereby incorporated by reference.

A pair of neoprene glazing gaskets, one for supporting marginal edge portions of the unit to be evaluated and the other for supporting a wooden shim were mounted in the glazing frame. A glazing plate having a pair of neoprene glazing gaskets spanning the shim and edges of the unit was secured to the glazing frame by the machine screws. The plate applied clamping pressure of greater than about 10 pounds per linear inch (1.8 kilograms per linear centimeter) to marginal edges of the unit to be tested to simulate expected clamping pressure in a glazing system.

The cavity was made air tight by (1) the glazing gaskets and (2) foam tape between the glazing frame and base to cyclicly pull a vacuum. A vacuum of 6 inches (15.24 centimeters) of water for 10 seconds followed by venting the cavity to the atmosphere for 10 seconds constituted one cycle. The cycle was continuously repeated during the evaluation period to simulate wind deflection on the unit under test.

Hot ethylene glycol was passed through the heat exchanger to heat the adjacent surface of the unit under test. The heating cycle had a duration of 4 hours. The temperature at the center of the pane adjacent the heat exchanger was recorded during the heating cycle. At the start of the heating cycle, the recorded temperature was about 98° F. (36.7° C.); after 1 hour about 200° F. (93.3° C.); after 2 hours about 225° F. (107.2° C.); after 3 hours about 125° F. (51.2° C.); and after 4 hours about 100° F. (37.8° C.). The heating cycle was continuously repeated during the test period to simulated exposure of the unit to solar energy and/or a heated room.

Unless indicated to the contrary, the units evaluated were constructed as follows. Spacer sections 20 or 24 filled with silica gel had their ends welded together to provide a spacer 15 or 20, respectively. The spacer was sized to provide a peripheral channel having a depth of about $\frac{1}{8}$ inch (0.32 centimeters). The spacer section 20 as viewed in FIG. 2 had a top width of about $\frac{1}{2}$ inch (1.27 centimeters) to provide a $\frac{1}{2}$ inch (1.27 centimeters) airspace 18; a bottom width of $\frac{3}{8}$ inch (0.96 centimeter); parallel sides having a height of about $\frac{1}{4}$ inch (0.64 centimeter); and a wall thickness of about 0.010 inches (0.0254 centimeter). The spacer section 24 as viewed in FIG. 4 had a width of about $\frac{1}{2}$ inch (1.27 centimeters); a height of about 11/32 (0.87 centimeter) and a wall thickness of about 0.035 inches (0.089 centimeter).

A layer of moisture-resistant adhesive of the type taught in U.S. Pat. No. 3,791,910 was applied to outer opposed surfaces of the spacer 16 or 20. A heat strengthened glass was mounted on each side of the spacer and the adhesive flowed as taught in U.S. Pat. No. 3,919,023 which teachings are hereby incorporated by reference to form a primary moisture-resistant seal.

The peripheral channel was filled with a hot melt adhesive as designated to provide a secondary moisture-resistant seal.

For purposes of the invention, a spacer displacement of ¼ inch (0.64 centimeter) or more constituted a failure because the spacer would move into the vision area. Spacer displacement was determined by marking the position of the spacer before evaluation and measuring its displacement during the test. Spacer bow is shown by a "+" following the spacer displacement value. The remaining values under Maximum Spacer Displacement are spacer bow values.

Table I shows particulars of tested or evaluated units that did not have a metal clip or an adhesive cleat. In Table I and in following Tables II–IV, the side is the length of the unit; the end is the width of the unit.

Cities Service sealants are firm, they may be used in the practice of the invention.

Table II shows particulars of units tested having metal clips. The clips used were made of stainless steel washers having a thickness of about 0.010 inches (0.025 centimeters) and a hole diameter of about 3/32 inch (0.24 centimeter). The units 7–10 of Table II have a length of 74 inches (1.85 meters) and a width of 34 inches (0.85 meters). Metal clips were not employed at the ends of the units because the width of the spacer at the ends was considered short enough to minimize the flexibility of the spacer.

Table II shows that metal clips aid in minimizing or eliminating spacer sag. However, as was discussed above, metal clips may cause glass edge damage and do not eliminate spacer bow.

Table I

| | | | Particulars of Tested Units Without Mechanical Clips or Adhesive Cleats | | | | | | | |
|---|---|---|---|---|---|---|---|---|---|---|
| | | | Unit Size | | Eval- | Right | Left | Top | Bottom | |
| Unit No. | Spacer Type | Secondary Seal | Side in inches (meters) | End in inches (meters) | uation Time (hours) | Side in inches (centimeters) | Side in inches (centimeters) | End in inches (centimeters) | End in inches (centimeters) | Result |
| 1 | 26 (FIG. 4) | Fuller Hot Melt HM-1081 | 74½ (1.86) | 34½ (0.86) | 90½ | 1-5/32 (2.94) | 9/16 (1.43) | 0 | 0 | Failed |
| 2 | 26 (FIG. 4) | National Starch 72-6192 | 74 (1.85) | 34 (0.85) | 23-1/12 | 9/16 (1.43) | ⅜ (0.95) | 0 | 0 | Failed |
| 3 | 21 (FIG. 2) | Fuller Hot Melt HM-1081 | 74 (1.85) | 34 (0.85) | 4⅔ | 1-7/16 (3.65) | 13/16 (2.06) | 0 | 1/32 (0.02) | Failed |
| 4 | 21 (FIG. 2) | Fuller-Hot Melt HM-1081 | 108 (2.7) | 50⅛ (1.25) | 24 | 1-15/16 (4.92) | 1¾ (4.45) | 0 | 0 | Failed |
| 5 | 21 (FIG. 2) | Cities Serice 761-4 (Grey) | 74 (1.85) | 34 (0.85) | 152 | 0 | 0 | 0 | 0 | Passed |
| 6 | 21 (FIG. 2) | Cities Service 680-9 (Black) | 74 (1.85) | 34 (0.85) | 152 | 0 | 0 | 0 | 0 | Passed |

Table II

| | | | Particulars of Tested Units Having Metal Clip | | | | | | | | |
|---|---|---|---|---|---|---|---|---|---|---|---|
| | | | | | | | Maximum Spacer Displacement | | | | |
| Unit No. | Spacer Type | Sealant in Peripheral Channel | Diameter of Clip in inches (centi-meters) | Clip Frequency Ends | Clip Frequency Sides | Test Time (hours) | Right Side in inches (centi-meters) | Left Side in inches (centi-meters) | Top End in inches (centi-meters) | Bottom End in inches (centi-meters) | Result |
| **7 | 26 (FIG. 4) | — | 11/16 (0.37) | 0 | 1 at midpoint | 116⅔ | 2⅜ (6.03) | 3/16 (0.48) | 0 | 0 | Failed |
| **8 | 26 (FIG. 4) | — | 13/16 (2.06) | 0 | 1 at midpoint | 117-5/12 | 13/16 (2.06) | 0 | 0 | 0 | Failed |
| 9 | 26 (FIG. 4) | Fuller Hot Melt HM-1081 | 13/16 (2.06) | 0 | 1 at ⅓ points | 180 | ⅛ (0.32) | ⅛ (0.32) | 1/16 (0.16) | 0 | Passed |
| 10 | 26 (FIG. 4) | Fuller Hot Melt HM-1081 | 13/16 (2.06) | 0 | 1 at midpoint | 297-1/6 | ¼ (0.64) | 3/16 (0.48) | 0 | 0 | Passed |

**The spacer of Units 7 and 8 was flush with peripheral edges of the glass sheets and had a flexible tape 64 (FIG. 6) and a metal channel 70 (FIG. 5).

Units 1–4 failed because the spacer bow on at least one side was greater than ¼ inch (0.64 centimeter). It was believed that there was no or minimal spacer displacement at the ends because the width of the spacer had a smaller bending moment than the length of the spacer. It is believed that units 5 and 6 did not have spacer displacement because Cities Service sealant is firmer than the National Starch or Fuller Hot Melt HN-1081. For example, a Shore A durometer test reading of Fuller Hot Melt, HM-1081, showed a drop from 40 to 11 in 5 seconds wherein a Shore A durometer test reading of Cities Services 761–4 showed a drop from 72 to 58 in 5 seconds. Although Cities Service's sealant does not require the cleats of the instant invention to prevent spacer displacement, there are sealants that when used in the construction of glazed units do not prevent spacer displacement. The instant invention is directed to improving those units. Further, because Table III list particulars for tested Units 11–18 having adhesive cleats of the invention. The units evaluated had a length of 76 inches (1.90 meters) and a width of 34 inches (0.85 meters). In the instance when the spacer 21 of FIG. 2 was used, the adhesive cleat filled the recesses 36 as shown in FIG. 2. For example for Unit 11 of Table III, a 12" (0.3 meters) long adhesive cleat of General Electric (G. E.) 3204 silicone filled opposed recesses 36 at the midpoint of the sides. In the instance where the spacer 24 of FIG. 4 was used, the adhesive cleat was on the base of the spacer and on inner surface of adjacent panes. The cleat had a generally triangular cross-sectional configuration having side dimensions of about between 1/32 inch–1/16 inch (0.08 centimeters–0.16 centimeters).

Table III shows that the adhesive cleats of the invention prevent or minimize spacer displacement. It is believed that Unit 11 passed and Units 12–14 failed because the adhesive cleats in Unit 11 was in the recesses 36 as shown in FIG. 2 and therefore was adhered to more glass and spacer surface area. The cleats of Units 12–14 were adhered to the base of the spacer 24 and inner surface of the adjacent glass sheet and therefore was adhered to less spacer and/or glass surface area. In addition, it is believed that Units 13 and 14 as well as Unit 16 failed because the adhesive cleats had a short length, i.e., 12 inches (0.3 meters) vs. 6 inches (0.15 meters) or 1 inch (2.54 centimeters). It is believed that Units 17 and 18 passed because 2 adhesive cleats each 6 inches (0.15 meters) long were used at the ⅓ points.

76½ inches (1.91 meters); a thickness of ¼ inch (0.64 centimeter); and an airspace of ½ inch (1.27 centimeters). Units 27–30 were made of glass sheets having a width of 50⅛ inches (1.253 meters); a length of 108 inches (2.7 meters); a thickness of ¼ inch (0.64 centimeters) and an airspace of ½ inch (1.27 centimeters).

Units 19, 22, 24, 25, 27, 28 and 30 had the adhesive cleats in the recess before the primary seal was flowed as taught in U.S. Pat. No. 3,919,023. Units 20, 21, 23, 26 and 29 had the cleat applied after the primary seal was flowed.

From Table IV, a schedule for adhesive cleat frequency to minimize or eliminate spacer displacement Table III Evaluation of Units Having Adhesive Cleats

| Unit No. | Spacer Type | Adhesive Cleat | Cleat Frequency Ends | Cleat Frequency Sides | Test Time (hours) | Maximum Spacer Displacement: Right Side in inches (centimeters) | Left Side in inches (centimeters) | Top End in inches (centimeters) | Bottom End in inches (centimeters) | Result |
|---|---|---|---|---|---|---|---|---|---|---|
| 11 | 21 (FIG. 2) | 12" (0.3 meters) Long G.E. 3204 Silicone | 0 | 2 at midpoint | 322 | 0 | 1/32+ (0.017) | 1/32+ (0.017) | 0 | Passed |
| 12 | 24 (FIG. 4) | 12" (0.3 meters) Long G.E. 3204 Silicone | 0 | 2 at midpoint | 168½ | 5/32 (0.397) | ⅛ (0.318) | 9/32 (0.714) | 1/32 (0.017) | Failed |
| 13 | 24 (FIG. 4) | 6" (0.15 meters) Long G.E. 3204 Silicone | 0 | 2 at midpoint | 21½ | ⅝ (1.588) | ⅛ (0.318) | 0 | 0 | Failed |
| 14 | 24 (FIG. 4) | 6" (0.15 meters) Long PRC 428 Polysulfide | 0 | 2 at midpoint | 21½ | 9/16 (1.429) | 7/16 (1.111) | 0 (0.017) | 1/32 | Failed |
| 15 | 21 (FIG. 2) | 6" (0.15 meters) Long G.E. 3204 Silicone | 0 | 2 at midpoint | 138 | ⅛ (0.318) | 3/32+ (0.238) | 7/32+ (0.556) | 3/32+ (0.238) | Failed |
| 16 | 21 (FIG. 2) | 1" (2.54 centimeters) Long G.E. 3204 Silicone | 2 at midpoint | 2 at midpoint | 21½ | 1 9/16 (3.969) | 5/32 (0.397) | 0 | 0 | Failed |
| ***17 | 21 (FIG. 2) | 6" (0.15 meters) Long G.E. 3204 Silicone | 2 at midpoint | 2 at ⅓ points | 215 | 3/32 (0.238) | 1/16 (0.159) | 0 | 0 | Passed |
| 18 | 21 (FIG. 2) | 6" (0.15 meters) Long G.E. 3204 Silicone | 2 at midpoint | 2 at ⅓ points | 215 | 3/32 (0.238) | 1/32 (0.017) | 0 | 0 | Passed |

***One glass sheet was coated with PPG Solarban 445 Coating.

Table IV shows particulars of tested units to determine frequency, size and location of the adhesive cleat of the instant invention to minimize or eliminate spacer displacement. Units 19–26 were made of glass sheets having a width of 34½ inches (0.86 meters); a length of was developed and is shown in Table V. As can be appreciated, the schedule in Table V is not limiting to the invention but is based on sound engineering judgment and is proposed as one that can be used to minimize if not eliminate spacer displacement.

Table IV

Particulars of Tested Units Having Adhesive Cleats to Determine Frequency, Size and Location

| Unit No. | Spacer Type | Adhesive Cleat | Cleat Frequency Ends | Cleat Frequency Sides | Test Time (hours) | Right Side in inches (centimeters) | Left End in inches (centimeters) | Top End in inches (centimeters) | Bottom End in inches (centimeters) | Result |
|---|---|---|---|---|---|---|---|---|---|---|
| 19 | 21 (FIG. 2) | 6" (0.15 meters) Long G.E. 3204 Silicone | 2 at midpoint | 2 at midpoint | 145 5/12 | 3/32 (0.238) | 3/32 (0.238) | 0 | 0 | Passed |
| 20 | 21 (FIG. 2) | 6" (0.15 meters) Long G.E. 3204 Silicone | 2 at midpoint | 2 at ⅓ points | 145 5/12 | 1/32 (0.079) | 1/16 (0.158) | 0 | 0 | Passed |
| 21 | 21 (FIG. 2) | 6" (0.15 meters) Inmont 1420 Polybutadiene | — | 2 at midpoint | 143½ | 1/32 (0.079) | 1/32 (0.079) | 0 | 0 | Passed |
| 22 | 21 (FIG. 2) | 6" (0.15 meters) Inmont 1420 Polybutadiene | 2 at midpoint | 2 at ⅓ points | 143½ | 1/32 (0.079) | 0 | 0 | 0 | Passed |
| 23 | 21 (FIG. 2) | 3" (0.075 meters) Long G.E. 3204 Silicone | 2 at midpoint | 2 at midpoint | 193½ | 5/64 (0.198) | 1/16 (0.158) | 0 | 0 | Passed |

Table IV-continued

| Unit No. | Spacer Type | Adhesive Cleat | Cleat Frequency Ends | Cleat Frequency Sides | Test Time (hours) | Right Side in inches (centimeters) | Left End in inches (centimeters) | Top End in inches (centimeters) | Bottom End in inches (centimeters) | Result |
|---|---|---|---|---|---|---|---|---|---|---|
| | | Particulars of Tested Units Having Adhesive Cleats to Determine Frequency, Size and Location | | | | | | | | |
| 24 | 21 (FIG. 2) | 3" (0.075 meters) Long G.E. 3204 Silicone | 2 at midpoint | 2 at ⅓ points | 141⅔ | 1/32 (0.079) | 1/32 (0.079) | 0 | 0 | Passed |
| 25 | 21 (FIG. 2) | 3" (0.075 meters) Inmont 1420 Polybutadiene | 2 at midpoint | 2 at midpoint | 20¾ | 2 3/32 (5.318) | 2 3/32 (5.318) | 1/16 (0.158) | 1/16 (0.158) | Failed |
| 26 | 21 (FIG. 2) | 3" (0.075 meters) Inmont 1420 Polybutadiene | 2 at midpoint | 2 at ⅓ points | 67 | 2 15/32 (6.271) | 9/16 (1.429) | 3/32 (0.238) | 1/16 (0.158) | Failed |
| 27 | 21 (FIG. 2) | 6" (0.15 meters) Long G.E. 3204 Silicone | 2 at midpoint | 2 at midpoint | 200 | ⅛ (0.318) | 0 | 0 | 1/32+ (0.079) | Passed |
| 28 | 21 (FIG. 2) | 6" (0.15 meters) Long G.E. 3204 Silicone | 2 at midpoint | 2 at ⅓ points | 238 | ⅛ (0.318) | 3/16 (0.476) | 0 | 1/32 (0.079) | Passed |
| 29 | 21 (FIG. 2) | 3" (0.075 meters) Long G.E. 3204 Silicone | 2 at midpoint | 2 at midpoint | 197 | ⅛ (0.318) | 3/16 (0.476) | 0 | 1/32 (0.079) | Passed |
| 30 | 21 (FIG. 2) | 3" (0.075 meters) Long G.E. 3204 Silicone | 2 at midpoint | 2 at ⅓ points | 42 | 1/32 (0.079) | 1 13/32 (3.572) | 0 | 0 | Failed |

TABLE V

RECOMMENDED ADHESIVE CLEAT FREQUENCY

| NUMBER OF CLEATS | FREQUENCY OF CLEAT | LENGTH OF CLEAT | LENGTH OF SPACER LEG |
|---|---|---|---|
| 2 | At Midpoint | 6 Inches (0.15 meters) | 0–84 Inches (0–2.1 meters) |
| 2 | At ⅓ Points | 6 Inches (0.15 meters) | 84–124 Inches (2.1–3.1 meters) |
| 2 | At ¼ Points And At Midpoint | 6 Inches (0.15 meters) | 124 Inches and Greater (3.1 meters and greater) |

DETAILED DESCRIPTION OF THE INVENTION

In addition to the construction of Units 11–30 of Tables III and IV, the following examples illustrate additional embodiments of the instant invention.

EXAMPLE I

With reference to FIGS. 1–3, two glass sheets 12 and 14 each having a length of about 8 feet (2.4 meters), a width of about 4 feet (1.2 meters) and a thickness of about ¼ inch (0.635 centimeter) are cleaned in any conventional manner. Sections of rolled aluminum having a wall thickness of about 0.020 inches (0.508 centimeter) are filled with a desiccant 30 and joined at their ends by corner keys (now shown) of the type used in the art to provide a spacer 16. Communication between the desiccant 30 and airspace 18 is through the lockseam 21.

The assembled spacer 16 has an outside length of about 95–¾ inches (2.394 meters), a width of about 47–¾ inches (1.194 meters) and a height of about 5/16 inch (0.794 centimeter) as viewed in FIG. 2. As shown in FIGS. 2 and 3, the spacer has a T-shaped cross section with the top of the "T" having a width of about ½ inch (1.27 centimeters). This width is maintained for a downward distance as shown in FIGS. 2 and 3 for about 3/16 inch (0.476 centimeter) after which the spacer decreases to a width of about ⅜inch (0.953 centimeter).

The spacer 16 is positioned between the pair of glass sheets 12 and 14 inset form the peripheral edges 34 of the sheets 12 and 14 to provide a peripheral channel 38 having a width of about ½ inch (1.27 centimeters) and a depth of about ⅛ inch (0.318 centimeter) and a pair of spaced peripheral recesess 36 having a maximum width of about 1/16 inch (0.159 centimeter) and a maximum depth of about ⅛ inch (0.318 centimeter).

In the long side of the unit, the recesses 36 on each side of the spacer are filled with General Electric's Silicone 1200 Adhesive to provide 2 equally spaced glue clips 40 in each recess. Each clip has a length of about 1-½ inches (3.81 centimeters). On the short side of the unit, there is provided one glue clip 40 centrally disposed between the corners of the unit in each recess. Each clip on the short side has a length of about 1-½ inches (3.81 centimeters). Thereafter the peripheral channel 38 and unfilled portions of the recesses 36 are filled with Fuller Hot Melt Sealant, HM-1081.

Four (4) units constructed in the above manner were installed in November, 1975, in Pittsburgh, Pennsylvania, and no spacer displacement has been observed.

The units of Example I were constructed and installed prior to the determination of Table V. The length of the adhesive cleats used in the units of Example I were based on experience at the time of construction without the data now available on Tables I–V.

EXAMPLE II

With reference to FIG. 4, glass sheets 12 and 14 having a length of about 20 inches (0.5 meters), a width of about 14 inches (0.35 meters) and a thickness of about 3/16 inch (0.476 centimeter) are cleaned in any conventional manner.

Extruded aluminum sections 24 having a square cross section and a wall thickness of about 0.020 inch (0.051 centimeter) are filled with the desiccant 30 and joined at their ends in any conventional manner. The assembled spacer 26 has an outside length of about 19-¾ inches (0.494 meters) and an outside width of 13-¾ inches (0.344 meters). Each side dimension of the spacer 26 as viewed in the cross section is ¼ inch (0.635 centimeter). The desiccant 30 communicated with the airspace 18 by way of the lockseam 23 of the spacer 26 as shown in FIG. 4.

Dow Corning Silicone 781 is flowed on the outer marginal edge portions 46 of the spacer 26 to a thickness of about 0.010 inch (0.025 centimeter). Thereafter, the glass sheets 12 and 14 are mounted on the spacer 26 and the peripheral channel 38 filled with the sealant of Example I.

EXAMPLE III

The glass sheets 12 and 14 of Example III are used in the construction of multiple glazed unit 56 of FIG. 6. The spacer-dehydrator element 58 of the type taught in U.S. Pat. No. 3,758,996 is positioned between the glass sheets 12 and 14. The element 58 has a width of about ½ inch (1.27 centimeter) as measured between marginal edge portions 62 and a height of about 5/16 inch (0.794 centimeter). The outer peripheral surface portions 50 of the spacer element 58 are generally flush with the peripheral edge portions 34 of the glass sheets 12 and 14.

Adhesive cleats or beads 40 of the silicone adhesive of the type used in Example I are flowed on the adjacent corners of the glass sheets and spacer element as shown in FIG. 6. The beads have a radius of about 3/32 inch (0.476 centimeter).

A composite strip having a moisture-impervious sealant 66 on a flexible base 64 is wrapped around the peripheral edge portions 34 of the glass sheets 12 and 14 and peripheral edge portions 60 of the spacer element 58 and extends over the outer marginal edge portions of the glass sheet to provide a moisture-impervious seal.

As can now be appreciated, the above examples were presented for illustration purposes only and are not limiting to the invention.

What is claimed is:

1. A method of making a multiple glazed unit to prevent spacer displacement comprising the steps of:

mounting a spacer between a pair of panes to provide an airspace therebetween;

selecting an adhesive having a shear property of greater than about 40 pounds per square inch (2.80 kilograms per squre centimeter) to prevent spacer displacement;

securing the panes and spacer together with at least one cleat of the adhesive of said selecting step to prevent spacer displacement; and sealing the panes and spacer with a sealant.

2. The method as set forth in claim 1 wherein the adhesive cleat has a shear property of greater than about 60 pounds per square inch (4.20 kilograms per square centimeter) at temperatures of up to about 130° F. (54° C.).

3. The method as set forth in claim 1 wherein said sealing step includes the steps of:

providing the sealant between marginal edge portions of the spacer and marginal edge portions of adjacent pane to form a primary seal; and providing the sealant on outer surface of the spacer and adjacent surface of adjacent pane to form a secondary seal; and said securing step includes the step of providing the at least one adhesive cleat between the primary and secondary seals.

4. The method as set forth in claim 1 wherein the panes are glass panes; the spacer is a dessicative spacer and the sealant is a moisture-impervious sealant.

5. The method as set forth in claim 1 wherein the adhesive has a lateral displacement of about ¼ inch (0.64 centimeter) at its shear property.

6. The method as set forth in claim 1 wherein said selecting step includes the step of:

testing adhesives to determine those adhesives having the shear property of greater than about 40 pounds per square inch (280 kilograms per square centimeter).

7. The method as set forth in claim 6 wherein the adhesives tested are selected from the group consisting of hot melt adhesives, silicone elastomers, polysulfide adhesives and polybutadiene adhesives.

8. The method as set forth in claim 1 wherein said securing step includes the steps of:

adhering one pane to the spacer with at least one adhesive cleat; and adhering the other pane to the spacer with at least one adhesive cleat.

9. The method as set forth in claim 8 wherein said mounting step includes the step of:

mounting the spacer inset form peripheral edge portions of the panels to form a peripheral channel; and said sealing step includes the step of flowing the sealant in the channel.

10. The method as set forth in claim 8 wherein said mounting step includes the step of:

forming a peripheral recess between the spacer and adjacent pane; and practicing said securing step in the peripheral recesses.

11. A multiple glazed unit comprising:

a pair of panes mounted about a spacer to provide an airspace therebetween;

at least one adhesive cleat adhering the spacer and panes together, the adhesive from the cleat selected for having a shear property of greater than about 40 pounds per square inch (2.80 kilograms per square centimeter) to prevent spacer displacement; and a sealant sealing the airspace.

12. The multiple glazed unit as set forth in claim 11 wherein the spacer is inset from peripheral edge portions of the panes to provide a peripheral channel for receiving the sealant.

13. The multiple glazed unit as set forth in claim 11 wherein side wall portions of the spacer are depressed so as to form a peripheral recess with adjacent pane and each recess has at least one adhesive cleat.

14. The multiple glazed unit a set forth in claim 11 wherein the adhesive has a shear property of at least about 60 pounds per square inch (4.20 kilograms per square centimeter) at temperatures of up to about 130° F.

15. The multiple glazed unit as set forth in claim 11 wherein the sealant is between marginal edge portions of the spacer and marginal edge portions of adjacent pane to form a primary seal and outer surface of the spacer and adjacent surface of adjacent pane to form a secondary seal and the at least one adhesive clear is between the seals.

16. The multiple glazed unit as set forth in claim 11 wherein the spacer is a desiccative spacer; the panes are glass panes and the sealant is a moisture-impervious sealant.

17. The multiple glazed unit as set forth in claim 11 wherein the adhesive has a lateral displacement of about ¼ inch (0.64 centimeter) at its shear property value.

18. The multiple glazed unit as set forth in claim 11 wherein adhesives selected for the cleat have been tested and found to have a shear property of greater than about 40 pounds per square inch (2.80 kilograms per square centimeter).

19. The multiple glazed unit as set forth in claim 18 whrein the adhesive is selected from the group consisting of hot melt adhesives, silicone elastomer adhesives, polysulfide adhesives and polybutadiene adhesives.

20. The multiple glazed unit as set forth in claim 11 wherein:

at least one adhesive cleat adheres the spacer to one of the panes; and at least one adhesive cleat adheres the spacer to the other pane.

21. The multiple glazed unit as set forth in claim 20 wherein the spacer of the unit has a rectangular shape having a predetermined length and the frequency and length of the cleat at each side is according to the following schedule:

| Length of Spacer at Side | Number of Cleats | Frequency of Cleats | Length of Cleats |
|---|---|---|---|
| 0–84 inches (0–2.1 meters) | 2 | One cleat at midpoint | 6 inches (0.15 meters) |
| 84–124 inches (2.1–3.1 meters) | 2 | One cleat at each ⅓ point | 6 inches (0.15 meters) |
| 124 inches and greater (3.1 meters and greater) | 2 | One cleat at each ¼ point | 6 inches (0.15 meters) |

22. The method as set forth in claim 1 wherein the unit has a rectangular shape and said securing step is practiced on each side of the unit.

* * * * *

UNITED STATES PATENT AND TRADEMARK OFFICE

CERTIFICATE OF CORRECTION

PATENT NO. : 4,193,236

DATED : March 18, 1980

INVENTOR(S) : Renato J. Mazzoni, George R. Mistrick and Barent A. Rosskamp

It is certified that error appears in the above-identified patent and that said Letters Patent are hereby corrected as shown below:

Claim 6, column 16, line 17, "280" should be --2.80--.

Claim 9, column 16, line 31, "form" should be --from--.

Claim 14, column 16, line 60, "a" should be --as--.

Claim 15, column 17, line 2, "clear" should be --cleat--.

Claim 19, column 17, line 19, "whrein" should be --wherein--.

Signed and Sealed this

*Eighth* Day of *July 1980*

[SEAL]

*Attest:*

SIDNEY A. DIAMOND

*Attesting Officer*

*Commissioner of Patents and Trademarl*